US012648590B2

(12) United States Patent
He

(10) Patent No.: US 12,648,590 B2
(45) Date of Patent: Jun. 9, 2026

(54) HARM-REDUCING CIGARETTE FILTER, PREPARATION METHOD AND APPLICATION THEREOF

(71) Applicant: Changde Jizhi Biological Technology Co., Ltd, Changde (CN)

(72) Inventor: Xinqiao He, Changde (CN)

(73) Assignee: CHANGDE JIZHI BIOLOGICAL TECHNOLOGY CO., LTD, Changde (CN)

( * ) Notice: Subject to any disclaimer, the term of this patent is extended or adjusted under 35 U.S.C. 154(b) by 416 days.

(21) Appl. No.: 18/450,492

(22) Filed: Aug. 16, 2023

(65) Prior Publication Data

US 2024/0188631 A1 Jun. 13, 2024

(30) Foreign Application Priority Data

Dec. 8, 2022 (CN) ..... 202211569862.7

(51) Int. Cl.

| | |
|---|---|
| ***A24D 3/04*** | (2006.01) |
| ***A24D 3/06*** | (2006.01) |
| ***A24D 3/10*** | (2006.01) |
| ***A24D 3/14*** | (2006.01) |
| ***A24D 3/16*** | (2006.01) |

(52) U.S. Cl.

CPC ..... *A24D 3/048* (2013.01); *A24D 3/062* (2013.01); *A24D 3/10* (2013.01); *A24D 3/14* (2013.01); *A24D 3/163* (2013.01); *A24D 3/166* (2013.01)

(58) Field of Classification Search

None

See application file for complete search history.

*Primary Examiner* — Phu H Nguyen

(74) *Attorney, Agent, or Firm* — Hemisphere Law, PLLC

(57) ABSTRACT

A harm-reducing cigarette filter, a method for preparing the cigarette filter and an application of the cigarette filter are disclosed, and the cigarette filter includes six layers from outside to inside: a first layer includes filter cotton with an activated carbon, a second layer includes a five-hole glue, a third layer includes filter cotton, a fourth layer includes filter particles, a fifth layer includes filter cotton with filter fluid, and a sixth layer includes a silica gel cover. The cigarette filter is injection molded by utilizing non-toxic polycarbonate (PC) or polymethylmethacrylate (PMMA). The experimental research shows that the cigarette filter has good adsorption effect on tar and nicotine, and reduces smoking people to absorb harmful substance.

20 Claims, 1 Drawing Sheet

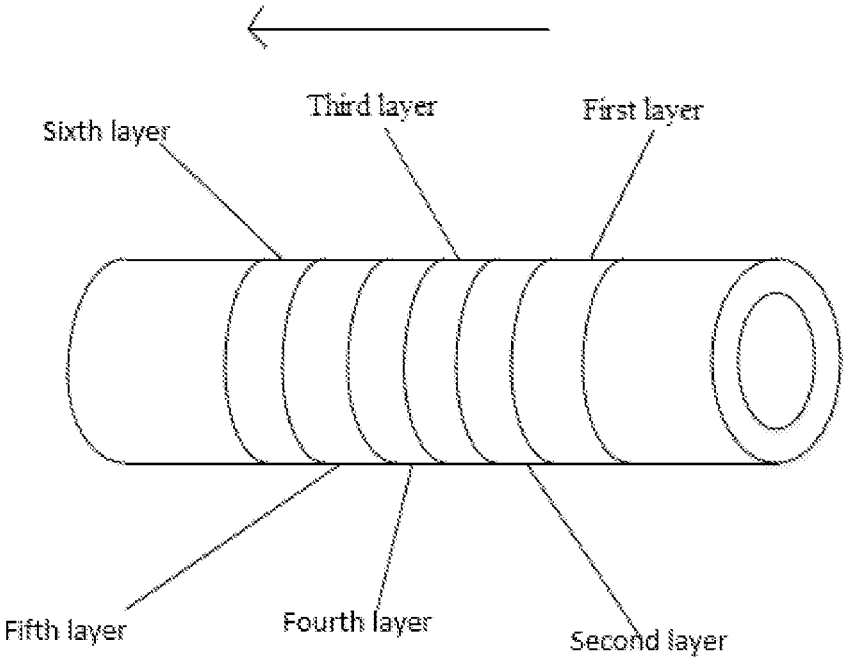
Sixth layer
Third layer
First layer
Fifth layer
Fourth layer
Second layer

HARM-REDUCING CIGARETTE FILTER, PREPARATION METHOD AND APPLICATION THEREOF

TECHNICAL FIELD

The disclosure relates to the technical field of cigarette filters, and particularly to a harm-reducing cigarette filter, and its preparation method and application.

BACKGROUND

It is universally known that smoking is harmful to health. In order to reduce the harm of smoking to health, many scientists are trying to find ways and design thousands of cigarette additives, filter cotton, filters and other products. Through filtering, adsorption and other intervention measures, these products can indeed reduce some of tar, nicotine and other harmful substances, but the disadvantage is that the serious carcinogens in cigarettes cannot be completely filtered out. On the basis of the prior art, developing a cigarette additive and a cigarette filter which can not only filter most of the tar, nicotine, phenol and crotonaldehyde, but also decompose and convert benzopyrene, nitrosamine, carbon monoxide, hydrogen cyanide, ammonia and other carcinogens and gases, and at the same time have the functions of space antibacterial, inactivating virus, preventing cold, pharyngitis, pneumonia, rhinitis, oral inflammation, purifying air, reducing the harm of smoking to human body and reducing the harm of second-hand smoke to other people, has a broad market space and creates huge economic value.

SUMMARY

Based on the above reasons, the applicant obtained a new cigarette filter after several creative efforts. The cigarette filter includes six layers from outside to inside: a first layer includes filter cotton with an activated carbon, a second layer includes a five-hole glue, a third layer includes filter cotton, a fourth layer includes filter particles, a fifth layer includes filter cotton with filter fluid, and a sixth layer includes a silica gel cover. The cigarette filter is injection molded by utilizing non-toxic polycarbonate (PC) or polymethylmethacrylate (PMMA). The experimental research shows that the cigarette filter of the disclosure has good adsorption effect on tar and nicotine, and reduces smoking people to absorb harmful substances.

The PC is a strong and tough thermoplastic resin with the characteristics of colorless transparency, heat resistance, impact resistance, flame retardancy, high refractive index, and good processing performance.

The PMMA is a kind of high molecular polymer and also known as acrylic or plexiglass. The PMMA has the advantages of high transparency, low price, easy machining, and is often used as a substitute for glass.

The disclosure is implemented through the following technical solutions.

The cigarette filter includes six layers from outside to inside: the first layer includes the filter cotton with the activated carbon, the second layer includes the five-hole glue, the third layer includes the filter cotton, the fourth layer includes the filter particles, the fifth layer includes the filter cotton with the filter fluid, and the sixth layer includes the silica gel cover. The cigarette filter is injection molded by utilizing non-toxic PC or PMMA. When using the cigarette filter, the silica gel cover is removed and the cigarette is inserted into the cigarette filter.

In an embodiment, each of the filter particles of the fourth layer is prepared from the following raw materials: nano-grade diatomaceous earth of 60-70 parts by weight, urea of 5-15 parts by weight, a lemon powder of 5-15 parts by weight, the activated carbon of 3-7 parts by weight with a iodine value of 1100, a nano aerogel of 2-4 parts by weight, nanometer titanium dioxide of 1-3 parts by weight, vitamin C of 1-5 parts by weight, chitosan of 0.5-1.5 parts by weight, a rock candy powder of 1-5 parts by weight, active nano zinc oxide of 1-5 parts by weight, a smoldered and distilled monazite crystal powder of 1-3 parts by weight and maize starch of 1-5 parts by weight.

The nano aerogel, as a new type of industrial thermal insulation material, has the characteristics of a low density, a low thermal conductivity and a high porosity. The thermal conductivity determines the thermal insulation effect of thermal insulation materials. The lower the thermal conductivity, the better the thermal insulation effect. The nano aerogel has a very low thermal conductivity of 0.020 watt per meter kelvin (W/m·K) at room temperature, so it has a good thermal insulation effect. The nano aerogel has stable chemical properties, does not decompose at high temperatures, and does not release harmful gases. It is an environmentally friendly and commercially available material.

In an embodiment, each of the filter particles of the fourth layer is prepared from the following raw materials: the nano-grade diatomaceous earth of 65 parts by weight, the urea of 10 parts by weight, the lemon powder of 10 parts by weight, the activated carbon of 5 parts by weight with the iodine value of 1100, the nano aerogel of 3 parts by weight, the nanometer titanium dioxide of 2 parts by weight, the vitamin C of 3 parts by weight, the chitosan of 1 part by weight, the rock candy powder of 3 parts by weight, the active nano zinc oxide of 3 parts by weight, the smoldered and distilled monazite crystal powder of 2 parts by weight and the maize starch of 3 parts by weight.

In an embodiment, the filter fluid of the fifth layer is prepared from the following raw materials: citric acid of 60-70 parts by weight, urea of 5-15 parts by weight, vitamin C of 5-15 parts by weight, chitosan of 2-4 parts by weight, a distillation solution of smoldered active nano zinc oxide of 4-6 parts by weight, a distillation solution of smoldered monazite of 2-4 parts by weight, an amino acid of 1-3 parts by weight, a nano aerogel of 1-3 parts by weight, purification water of 80-120 parts by weight.

The amino acid is an organic compound containing alkaline amino groups and acidic carboxyl groups, which is a compound formed by substitution of the hydrogen atom connected to the carbon atom of the carboxylic acid with the amino group. And the amino acid is commercially available.

In an embodiment, the filter fluid of the fifth layer is prepared from the following raw materials: the citric acid of 65 parts by weight, the urea of 10 parts by weight, the vitamin C of 10 parts by weight, the chitosan of 3 parts by weight, the distillation solution of smoldered active nano zinc oxide of 5 parts by weight, the distillation solution of smoldered monazite of 3 parts by weight, the amino acid of 2 parts by weight, the nano aerogel of 2 parts by weight, the purification water of 100 parts by weight.

In an embodiment, a preparing method of the distillation solution of smoldered active nano zinc oxide is as follows: placing nano zinc oxide in a high-temperature furnace at 1800-2200 degrees Celsius (° C.), firing the nano zinc oxide for 75-105 minutes (min) and then cooling down to obtain a fired power. After the cooling down, placing the fired powder in a cloth bag of 800-1200 meshes and then evaporating in a steam oven to obtain the distillation solution.

In an embodiment, a preparing method of the distillation solution of smoldered monazite is as follows: crushing a monazite to obtain a crushed powder, placing the crushed powder in a high-temperature furnace at 1800-2200° C., firing the crushed powder for 75-105 min and then cooling down to obtain a fired powder. After the cooling down, placing the fired powder in a cloth bag of 800-1200 meshes and then evaporating in a steam oven to obtain the distillation solution and a distilled monazite, and crushing the distilled monazite to obtain the smoldered and distilled monazite crystal powder.

In an embodiment, the filter particles of the fourth layer are prepared by mixing the raw materials of the fourth layer to obtain a mixture, placing the mixture in a granulator for granulation to obtain particles with a size of 0.1-3 millimeters (mm), and placing 30-100 particles as the filter particles in the fourth layer.

In an embodiment, the filter fluid of the fifth layer is prepared by mixing the raw materials of the fifth layer evenly to obtain a mixture and dripping 0.1-3 milliliters (ml) of the mixture as the filter fluid into the filter cotton of the fifth layer at a bottom of the cigarette filter through using an automatic metering glue dripping machine.

The above raw materials are provided free of charge by Longyu Yiyao (Beijing) Technology Co., Ltd.

The beneficial technical effect lies in the application of "the filter particles" and "the filter fluid" in the cigarette filter. The components of the filter particles and the filter fluid can be obtained from the market, and the raw materials are easy to obtain, which is suitable for industrial production.

The cigarette filter has a good adsorption effect on harmful substances such as tar and nicotine in cigarettes, so as to reduce the damage of cigarettes to human body.

BRIEF DESCRIPTION OF DRAWING

FIGURE is a schematic structure diagram of a cigarette filter of the disclosure, in which an arrow indicates a direction from outside to inside.

EMBODIMENTS

In order to make the purpose, technical solution and advantages of the disclosure more clearly, the following will provide a further detailed explanation of the disclosure in conjunction with specific embodiments. It should be understood that descriptions are only illustrative and not intended to limit the scope of the disclosure. In addition, in the following explanation, the description of well-known structures and techniques has been omitted to avoid unnecessary confusion with the concepts of the disclosure.

Embodiment 1

The cigarette filter includes six layers from outside to inside: a first layer includes filter cotton with an activated carbon, a second layer includes a five-hole glue, a third layer includes filter cotton, a fourth layer includes filter particles, a fifth layer includes filter cotton with filter fluid, and a sixth layer includes a silica gel cover. The cigarette filter is injection molded by utilizing non-toxic PC or PMMA. When using the cigarette filter, the silica gel cover is removed and the cigarette is inserted into the cigarette filter.

Each of the filter particles of the fourth layer is prepared from the following raw materials: nano-grade diatomaceous earth of 60 grams (g), urea of 5 g, a lemon powder of 5 g, the activated carbon of 3 g with an iodine value of 1100, a nano aerogel of 2 g, nanometer titanium dioxide of 1 g. vitamin C of 1 g, chitosan of 0.5 g, a rock candy powder of 1 g, active nano zinc oxide of 1 g. a smoldered and distilled monazite crystal powder of 1 g and maize starch of 1 g.

The filter fluid of the fifth layer is prepared from the following raw materials: citric acid of 60 g, urea of 5 g, vitamin C of 5 g, chitosan of 2 g, a distillation solution of smoldered active nano zinc oxide of 4 g. a distillation solution of smoldered monazite of 2 g, an amino acid of 1 g, a nano aerogel of 1 g, purification water of 80 g.

A preparing method of the distillation solution of smoldered active nano zinc oxide is as follows: nano zinc oxide is placed in a high-temperature furnace at 1800° C., fired for 105 min and then cooled down to obtain a fired power, and the fired powder is placed in a cloth bag of 800 meshes and then evaporated in a steam oven to obtain the distillation solution.

A preparing method of the distillation solution of smoldered monazite is as follows: a monazite is crushed to obtain a crushed powder, the crushed powder is placed in a high-temperature furnace at 1800° C., fired for 105 min, and then cooled down to obtain a fired powder. The fired powder is placed in a cloth bag of 800 meshes and then evaporated in a steam oven to obtain the distillation solution and a distilled monazite. And the distilled monazite is crushed to obtain the smoldered and distilled monazite crystal powder.

The filter particles of the fourth layer are prepared by mixing the raw materials of the fourth layer to obtain a mixture, placing the mixture in a granulator for granulation to obtain particles with a size of 0.1-3 mm, and placing 30 particles as the filter particles in the fourth layer.

The filter fluid of the fifth layer is prepared by mixing the raw materials of the fifth layer evenly to obtain a mixture and dripping 3 ml of the mixture as the filter fluid into the filter cotton of the fifth layer at a bottom of the cigarette filter through using an automatic metering glue dripping machine.

Embodiment 2

The cigarette filter includes six layers from outside to inside: a first layer includes filter cotton with an activated carbon, a second layer includes a five-hole glue, a third layer includes filter cotton, a fourth layer includes filter particles, a fifth layer includes filter cotton with filter fluid, and a sixth layer includes a silica gel cover. The cigarette filter is injection molded by utilizing non-toxic PC or PMMA. When using the cigarette filter, the silica gel cover is removed and the cigarette is inserted into the cigarette filter.

Each of the filter particles of the fourth layer is prepared from the following raw materials: nano-grade diatomaceous earth of 70 g, urea of 15 g, a lemon powder of 15 g, the activated carbon of 7 g with an iodine value of 1100, a nano aerogel of 4 g, nanometer titanium in dioxide of 3 g, vitamin C of 5 g, chitosan of 1.5 g, a rock candy powder of 5 g, active nano zinc oxide of 5 g, a smoldered and distilled monazite crystal powder of 3 g and maize starch of 5 g.

The filter fluid of the fifth layer is prepared from the following raw materials: citric acid of 70 g, urea of 15 g, vitamin C of 15 g, chitosan of 4 g, a distillation solution of smoldered active nano zinc oxide of 6 g. a distillation solution of smoldered monazite of 4 g, an amino acid of 3 g, a nano aerogel of 3 g, purification water of 120 g.

A preparing method of the distillation solution of smoldered active nano zinc oxide is as follows: nano zinc oxide is placed in a high-temperature furnace at 2000° C. fired for 75 min and then cooled down to obtain a fired power. After the cooling down, the fired powder is placed in a cloth bag of 1200 meshes and then evaporated in a steam oven to obtain the distillation solution.

A preparing method of the distillation solution of smoldered monazite is as follows: a monazite is crushed to obtain a crushed powder, the crushed powder is placed in a high-temperature furnace at 2200° C., and fired for 75 min, and then cooled down to obtain a fired powder. After the cooling down, the fired powder is placed in a cloth bag of 1200 meshes and then evaporated in a steam oven to obtain the distillation solution and a distilled monazite. And then the distilled monazite is crushed to obtain the smoldered and distilled monazite crystal powder.

The filter particles of the fourth layer are prepared by mixing the raw materials of the fourth layer to obtain a mixture, placing the mixture in a granulator for granulation to obtain particles with a size of 0.1-3 mm, and placing 100 particles as the filter particles in the fourth layer.

The filter fluid of the fifth layer is prepared by mixing the raw materials of the fifth layer evenly to obtain a mixture and dripping 0.1 ml of the mixture as the filter fluid into the filter cotton of the fifth layer at a bottom of the cigarette filter through using an automatic metering glue dripping machine.

Embodiment 3

The cigarette filter includes six layers from outside to inside: a first layer includes filter cotton with an activated carbon, a second layer includes a five-hole glue, a third layer includes filter cotton, a fourth layer includes filter particles, a fifth layer includes filter cotton with filter fluid, and a sixth layer includes a silica gel cover. The cigarette filter is injection molded by utilizing non-toxic PC or PMMA. When using the cigarette filter, the silica gel cover is removed and the cigarette is inserted into the cigarette filter.

Each of the filter particles of the fourth layer is prepared from the following raw materials: nano-grade diatomaceous earth of 65 g, urea of 10 g, a lemon powder of 10 g, an activated carbon of 5 g with an iodine value of 1100, a nano aerogel of 3 g, nanometer titanium dioxide of 2 g, vitamin C of 3 g, chitosan of 1 g, a rock candy powder of 3 g, active nano zinc oxide of 3 g, a smoldered and distilled monazite crystal powder of 2 g and maize starch of 3 g.

The filter fluid of the fifth layer is prepared from the following raw materials: citric acid of 65 g, urea of 10 g, vitamin C of 10 g, chitosan of 3 g, a distillation solution of smoldered active nano zinc oxide of 5 g. a distillation solution of smoldered monazite of 3 g, an amino acid of 2 g, a nano aerogel of 2 g, purification water of 100 g.

A preparing method of the distillation solution of smoldered active nano zinc oxide is as follows: nano zinc oxide is placed in a high-temperature furnace at 2000° C., fired for 90 min and then cooled down to obtain a fired power. After the cooling down, the fired powder is placed in a cloth bag of 1000 meshes and then evaporated in a steam oven to obtain the distillation solution.

A preparing method of the distillation solution of smoldered monazite is as follows: a monazite is crushed to obtain a crushed powder, the crushed powder is placed in a high-temperature furnace at 2000° C., fired for 95 min, and then cooled down to obtain a fired powder. After the cooling down, the fired powder is placed in a cloth bag of 1000 meshes and then evaporated in a steam oven to obtain the distillation solution and a distilled monazite. And the distilled monazite is crushed to obtain the smoldered and distilled monazite crystal powder.

The filter particles of the fourth layer are prepared by mixing the raw materials of the fourth layer to obtain a mixture, placing the mixture in a granulator for granulation to obtain particles with a size of 0.1-3 mm, and placing 65 particles as the filter particles in the fourth layer.

The filter fluid of the fifth layer is prepared by mixing the raw materials of the fifth layer evenly to obtain a mixture and then dripping 1.5 ml of the mixture as the filter fluid into the filter cotton of the fifth layer at a bottom of the cigarette filter through using an automatic metering glue dripping machine.

Embodiment 4

The cigarette filter includes six layers from outside to inside: a first layer includes filter cotton with an activated carbon, a second layer includes a five-hole glue, a third layer includes filter cotton, a fourth layer includes filter particles, a fifth layer includes filter cotton with filter fluid, and a sixth layer includes a silica gel cover. The cigarette filter is injection molded by utilizing non-toxic PC or PMMA plastic. When using the cigarette filter, the silica gel cover is removed and the cigarette is inserted into the cigarette filter.

Each of the filter particles of the fourth layer is prepared from the following raw materials: nano-grade diatomaceous earth of 62 g, urea of 7 g, a lemon powder of 8 g, an activated carbon of 4 g with an iodine value of 1100, a nano aerogel of 2.5 g, nanometer titanium dioxide of 1.5 g. vitamin C of 2 g, chitosan of 0.8 g, a rock candy powder of 2 g, active nano zinc oxide of 2 g. a smoldered and distilled monazite crystal powder of 1.5 g and maize starch of 1.5 g.

The filter fluid of the fifth layer is prepared from the following raw materials: citric acid of 63 g, urea of 6 g, vitamin C of 7 g, chitosan of 2.5 g, a distillation solution of smoldered active nano zinc oxide of 4.5 g. a distillation solution of smoldered monazite of 2.5 g, an amino acid of 1.5 g, a nano aerogel of 1.5 g, purification water of 90 g.

A preparing method of the distillation solution of smoldered active nano zinc oxide is as follows: nano zinc oxide is placed in a high-temperature furnace at 1900° C., fired for 100 min and then cooled down to obtain a fired power. After the cooling down, the fired powder is placed in a cloth bag of 900 meshes and then evaporated in a steam oven to obtain the distillation solution.

A preparing method of the distillation solution of smoldered monazite is as follows: a monazite is crushed to obtain a crushed powder, the crushed powder is placed in a high-temperature furnace at 1900° C., and fired for 100 min, and then cooled down to obtain a fired powder. After the cooling down, the fired powder is placed in a cloth bag of 900 meshes and then evaporated in a steam oven to obtain the distillation solution and a distilled monazite. And the distilled monazite is crushed to obtain the smoldered and distilled monazite crystal powder.

The filter particles of the fourth layer are prepared by mixing the raw materials of the fourth layer to obtain a mixture, the mixture is placed in a granulator for granulation to obtain particles with a size of 0.1-3 mm, and 45 particles are placed as the filter particles in the fourth layer.

The filter fluid of the fifth layer is prepared by mixing the raw materials of the fifth layer evenly to obtain a mixture and then dripping 2.5 ml of the mixture as the filter fluid into the filter cotton of the fifth layer at a bottom of the cigarette filter through using an automatic metering glue dripping machine.

Embodiment 5

The cigarette filter includes six layers from outside to inside: a first layer includes filter cotton with an activated carbon, a second layer includes a five-hole glue, a third layer includes filter cotton, a fourth layer includes filter particles, a fifth layer includes filter cotton with filter fluid, and a sixth layer includes a silica gel cover. The cigarette filter is injection molded by utilizing non-toxic PC or PMMA. When using the cigarette filter, the silica gel cover is removed and the cigarette is inserted into the cigarette filter.

Each of the filter particles of the fourth layer is prepared from the following raw materials: nano-grade diatomaceous earth of 68 g, urea of 14 g, a lemon powder of 14 g, an activated carbon of 6 g with an iodine value of 1100, a nano aerogel of 3.5 g, nanometer titanium dioxide of 2.5 g, vitamin C of 4 g, chitosan of 1.3 g, a rock candy powder of 4 g, active nano zinc oxide of 4 g. a smoldered and distilled monazite crystal powder of 2.5 g and maize starch of 4.5 g.

The filter fluid of the fifth layer is prepared from the following raw materials: citric acid of 68 g, urea of 13 g, vitamin C of 13 g, chitosan of 3.5 g, a distillation solution of smoldered active nano zinc oxide of 5.5 g. a distillation solution of smoldered monazite of 3.5 g, an amino acid of 2.5 g, a nano aerogel of 2.5 g, purification water of 110 g.

A preparing method of the distillation solution of smoldered active nano zinc oxide is as follows: nano zinc oxide is placed in a high-temperature furnace at 2100° C., fired for 80 min and then cooled down to obtain a fired power. After the cooling down, the fired powder is placed in a cloth bag of 1100 meshes and then evaporated in a steam oven to obtain the distillation solution.

A preparing method of the distillation solution of smoldered monazite is as follows: a monazite is crushed to obtain a crushed powder, the crushed powder is placed in a high-temperature furnace at 2100° C. fired 85 min, and then cooled down to obtain a fired powder. After the cooling down, the fired powder is placed in a cloth bag of 1100 meshes and then evaporated in a steam oven to obtain the distillation solution and a distilled monazite. And the distilled monazite is crushed to obtain the smoldered and distilled monazite crystal powder.

The filter particles of the fourth layer are prepared by mixing the raw materials of the fourth layer to obtain a mixture, placing the mixture in a granulator for granulation to obtain particles with a size of 0.1-3 mm, and placing 90 particles as the filter particles in the fourth layer.

The filter fluid of the fifth layer is prepared by mixing the raw materials of the fifth layer evenly to obtain a mixture and then dripping 1.5 ml of the mixture as the filter fluid into the filter cotton of the fifth layer at a bottom of the cigarette filter through using an automatic metering glue dripping machine.

Comparative Embodiment 1

The cigarette filter includes six layers from outside to inside: a first layer includes filter cotton with an activated carbon, a second layer includes a five-hole glue, a third layer includes filter cotton, a fourth layer includes filter particles, a fifth layer includes filter cotton with filter fluid, and a sixth layer includes a silica gel cover. The cigarette filter is injection molded by utilizing non-toxic PC or PMMA. When using the cigarette filter, the silica gel cover is removed and the cigarette is inserted into the cigarette filter.

Each of the filter particles of the fourth layer is prepared from the following raw materials: nano-grade diatomaceous earth of 65 g, urea of 10 g, a lemon powder of 10 g, nanometer titanium dioxide of 2 g, vitamin C of 3 g, chitosan of 1 g, a rock candy powder of 3 g, active nano zinc oxide of 3 g and maize starch of 3 g.

The filter fluid of the fifth layer is prepared from the following raw materials: citric acid of 65 g, urca of 10 g, vitamin C of 10 g, chitosan of 3 g, a distillation solution of smoldered active nano zinc oxide of 5 g. a distillation solution of smoldered monazite of 3 g, an amino acid of 2 g, a nano aerogel of 2 g and purification water of 100 g.

A preparing method of the distillation solution of smoldered active nano zinc oxide is as follows: nano zinc oxide is placed in a high-temperature furnace at 2000° C., fired for 90 min and then cooled down to obtain a fired power. After the cooling down, the fired powder is placed in a cloth bag of 1000 meshes and then evaporated in a steam oven to obtain the distillation solution.

A preparing method of the distillation solution of smoldered monazite is as follows: a monazite is crushed to obtain a crushed powder, the crushed powder is placed in a high-temperature furnace at 2000° C., and fired for 95 min, and then cooled down to obtain a fired powder. After the cooling down, the fired powder is placed in a cloth bag of 1000 meshes and then evaporated in a steam oven to obtain the distillation solution and a distilled monazite. And the distilled monazite is crushed to obtain the smoldered and distilled monazite crystal powder.

The filter particles of the fourth layer are prepared by mixing the raw materials of the fourth layer to obtain a mixture, placing the mixture in a granulator for granulation to obtain particles with a size of 0.1-3 mm, and placing 65 particles as the filter particles in the fourth layer.

The filter fluid of the fifth layer is prepared by mixing the raw materials of the fifth layer evenly to obtain a mixture and then dripping 1.5 ml of the mixture as the filter fluid into the filter cotton of the fifth layer at a bottom of the cigarette filter through using an automatic metering glue dripping machine.

Comparative Embodiment 2

The cigarette filter includes six layers from outside to inside: a first layer includes filter cotton with an activated carbon, a second layer includes a five-hole glue, a third layer includes filter cotton, a fourth layer includes filter particles, a fifth layer includes filter cotton with filter fluid, and a sixth layer includes a silica gel cover. The cigarette filter is injection molded by utilizing non-toxic PC or PMMA. When using the cigarette filter, the silica gel cover is removed and the cigarette is inserted into the cigarette filter.

Each of the filter particles of the fourth layer is prepared from the following raw materials: nano-grade diatomaceous earth of 65 g, urea of 10 g, a lemon powder of 10 g, an activated carbon of 5 g with an iodine value of 1100, a nano aerogel of 3 g, nanometer titanium dioxide of 2 g, vitamin C of 3 g, chitosan of 1 g, a rock candy powder of 3 g, active nano zinc oxide of 3 g, a smoldered and distilled monazite crystal powder of 2 g and maize starch of 3 g.

The filter fluid of the fifth layer is prepared from the following raw materials: citric acid of 65 g, urca of 10 g, chitosan of 3 g, a distillation solution of smoldered monazite of 3 g. an amino acid of 2 g. a nano aerogel of 2 g, purification water of 80 g.

A preparing method of the distillation solution of smoldered active nano zinc oxide is as follows: nano zinc oxide is placed in a high-temperature furnace at 2000° C., fired for 90 min and then cooled down to obtain a fired power. After the cooling down, the fired powder is placed in a cloth bag of 1000 meshes and then evaporated in a steam oven to obtain the distillation solution.

A preparing method of the distillation solution of smoldered monazite is as follows: a monazite is crushed to obtain a crushed powder, the crushed powder is placed in a high-temperature furnace at 2000° C., fired for 95 min, and then cooled down to obtain a fired powder. After the cooling down, the fired powder is placed in a cloth bag of 1000 meshes and then evaporated in a steam oven to obtain the distillation solution and a distilled monazite. And the distilled monazite is crushed to obtain the smoldered and distilled monazite crystal powder.

The filter particles of the fourth layer are prepared by mixing the raw materials of the fourth layer to obtain a mixture, placing the mixture in a granulator for granulation to obtain particles with a size of 0.1-3 mm, and placing 65 particles as the filter particles in the fourth layer.

The filter fluid of the fifth layer is prepared by mixing the raw materials of the fifth layer evenly to obtain a mixture and then dripping 1.5 ml of the mixture as the filter fluid into the filter cotton of the fifth layer at a bottom of the cigarette filter through using an automatic metering glue dripping machine.

Experimental Embodiment

An adsorption effect of the cigarette filter on tar and nicotine in cigarettes.

An experimental method is as follows: commercial Zhongnanhai (soft boutique) cigarettes (tar content 10 milligrams per cigarette abbreviated as mg/cig, nicotine content 0.9 mg/cig) are bought and divided into different experimental groups:

- a control group: disposable filter cigarette (LVSAN) of throw-out type for 20 cigarettes on the market (one cigarette with one cigarette filter);
- an experimental group 1: the cigarette filter of embodiment 3 for 20 cigarettes (one cigarette with one cigarette filter);
- an experimental group 2: the cigarette filter of embodiment 4 for 20 cigarettes (one cigarette with one cigarette filter);
- an experimental group 3: the cigarette filter of comparative embodiment 1 for 20 cigarettes (one cigarette with one cigarette filter);
- an experimental group 4: the cigarette filter of comparative embodiment 2 for 20 cigarettes (one cigarette with one cigarette filter).

The cigarettes with the cigarette filters of different groups are put into Borgwaldt KC RM200A smoking machine in turn and burned. After the burning, the tar content and nicotine content in each cigarette filter is detected and an average value is calculated. As shown in Table 1 for the experiment results.

TABLE 1 comparison of adsorption of tar and nicotine on different cigarette filters

| group | tar content (mg per cigarette) | nicotine content (mg per cigarette) |
|---|---|---|
| control group | 6.3 | 0.54 |
| experimental group 1 | 8.5 | 0.75 |
| experimental group 2 | 8.2 | 0.72 |
| experimental group 3 | 6.9 | 0.58 |
| experimental group 4 | 6.7 | 0.58 |

Experimental conclusion: the above experiment shows that the cigarette filter of the disclosure has a good adsorption effect on tar and nicotine in cigarettes. Compared with commercially available cigarette filters and cigarette filters of comparative embodiments, the cigarette filter of the disclosure can significantly decrease the tar and nicotine content in the mouth of smokers and adsorb more than 80% of tar and nicotine in cigarettes. This fully demonstrates that the cigarette filter of the disclosure has scientific significance.

The above are only the specific embodiments of the disclosure. It should be pointed out that for those skilled in the art, several improvements and embellishments can be made without departing from the principles of the disclosure. These improvements and embellishments should also be considered as the scope of protection of the disclosure.

What is claimed is:

1. A cigarette filter comprising six layers; wherein the six layers comprise a first layer including filter cotton with an activated carbon, a second layer including five-hole glue, a third layer including filter cotton, a fourth layer including filter particles, a fifth layer including filter cotton with filter fluid, and a sixth layer including a silica gel cover; and the first though sixth layers are sequentially arranged from outside to inside in that order; and wherein the cigarette filter is injection molded by utilizing one of non-toxic polycarbonate (PC) and polymethylmethacrylate (PMMA).

2. The cigarette filter as claimed in claim 1, wherein each of the filter particles of the fourth layer is prepared from the following raw materials: nano-grade diatomaceous earth of 60-70 parts by weight, urea of 5-15 parts by weight, a lemon powder of 5-15 parts by weight, the activated carbon of 3-7 parts by weight with an iodine value of 1100, a nano aerogel of 2-4 parts by weight, nanometer titanium dioxide of 1-3 parts by weight, vitamin C of 1-5 parts by weight, chitosan of 0.5-1.5 parts by weight, a rock candy powder of 1-5 parts by weight, active nano zinc oxide of 1-5 parts by weight, a smoldered and distilled monazite crystal powder of 1-3 parts by weight and maize starch of 1-5 parts by weight.

3. The cigarette filter as claimed in claim 1, wherein each of the filter particles of the fourth layer is prepared from the following raw materials: nano-grade diatomaceous earth of 65 parts by weight, urea of 10 parts by weight, a lemon powder of 10 parts by weight, the activated carbon of 5 parts by weight with an iodine value of 1100, a nano aerogel of 3 parts by weight, nanometer titanium dioxide of 2 parts by weight, vitamin C of 3 parts by weight, chitosan of 1 part by weight, a rock candy powder of 3 parts by weight, active nano zinc oxide of 3 parts by weight, a smoldered and distilled monazite crystal powder of 2 parts by weight and maize starch of 3 parts by weight.

4. The cigarette filter as claimed in claim 1, wherein the filter fluid of the fifth layer is prepared from the following raw materials: citric acid of 60-70 parts by weight, urea of 5-15 parts by weight, vitamin C of 5-15 parts by weight, chitosan of 2-4 parts by weight, a distillation solution of smoldered active nano zinc oxide of 4-6 parts by weight, a distillation solution of smoldered monazite of 2-4 parts by weight, an amino acid of 1-3 parts by weight, a nano aerogel of 1-3 parts by weight, purification water of 80-120 parts by weight.

5. The cigarette filter as claimed in claim 1, wherein the filter fluid of the fifth layer is prepared from the following raw materials: citric acid of 65 parts by weight, urea of 10 parts by weight, vitamin C of 10 parts by weight, chitosan of 3 parts by weight, a distillation solution of smoldered active nano zinc oxide of 5 parts by weight, a distillation solution of smoldered monazite of 3 parts by weight, an amino acid of 2 parts by weight, a nano aerogel of 2 parts by weight, purification water of 100 parts by weight.

6. The cigarette filter as claimed in claim 2, wherein a preparing method of the distillation solution of smoldered active nano zinc oxide comprises: placing nano zinc oxide in a high-temperature furnace at 1800-2200 degrees Celsius (° C.), firing the nano zinc oxide for 75-105 minutes (min) and then cooling down to obtain a fired power; and placing the fired powder in a cloth bag of 800-1200 meshes and then evaporating in a steam oven to obtain the distillation solution.

7. The cigarette filter as claimed in claim 2, wherein a preparing method of the distillation solution of smoldered monazite comprises: crushing a monazite to obtain a crushed powder, placing the crushed powder in a high-temperature furnace at 1800-2200° C., firing the crushed powder for 75-105 min and then cooling down to obtain a fired powder; placing the fired powder in a cloth bag of 800-1200 meshes and then evaporating in a steam oven to obtain the distillation solution and a distilled monazite; and crushing the distilled monazite to obtain the smoldered and distilled monazite crystal powder.

8. The cigarette filter as claimed in claim 2, wherein the filter particles of the fourth layer are prepared by mixing the raw materials of the fourth layer to obtain a mixture, placing the mixture in a granulator for granulation to obtain particles with a size of 0.1-3 millimeters (mm), and placing 30-100 particles as the filter particles in the fourth layer.

9. The cigarette filter as claimed in claim 4, wherein the filter fluid of the fifth layer is prepared by mixing the raw materials of the fifth layer evenly to obtain a mixture and dripping 0.1-3 milliliters (ml) of the mixture as the filter fluid into the filter cotton of the fifth layer at a bottom of the cigarette filter through using an automatic metering glue dripping machine.

10. A cigarette filter comprising: a first layer, a second layer, a third layer, a fourth layer, a fifth layer, and a silica gel cover sequentially stacked from outside to inside in that order, wherein the first layer includes filter cotton with an activated carbon, the second layer includes five-hole glue, the third layer includes filter cotton, the fourth layer includes filter particles, and the fifth layer includes filter cotton with filter fluid.

11. The cigarette filter as claimed in claim 10, wherein each of the filter particles of the fourth layer is prepared from the following raw materials: nano-grade diatomaceous earth of 60-70 g, urea of 5-15 g, a lemon powder of 5-15 g, the activated carbon of 3-7 g with an iodine value of 1100, a nano aerogel of 2-4 g, nanometer titanium dioxide of 1-3 g, vitamin C of 1-5 g, chitosan of 0.5-1.5 g, a rock candy powder of 1-5 g, active nano zinc oxide of 1-5 g, a smoldered and distilled monazite crystal powder of 1-3 g and maize starch of 1-5 g.

12. The cigarette filter as claimed in claim 10, wherein each of the filter particles of the fourth layer is prepared from the following raw materials: nano-grade diatomaceous earth of 65 g, urea of 10 g, a lemon powder of 10 g, the activated carbon of 5 g with a iodine value of 1100, a nano aerogel of 3 g, nanometer titanium dioxide of 2 g, vitamin C of 3 g, chitosan of 1 g, a rock candy powder of 3 g, active nano zinc oxide of 3 g, a smoldered and distilled monazite crystal powder of 2 g and maize starch of 3 g.

13. The cigarette filter as claimed in claim 10, wherein the filter fluid of the fifth layer is prepared from the following raw materials: citric acid of 60-70 g, urea of 5-15 g, vitamin C of 5-15 g, chitosan of 2-4 g, a distillation solution of smoldered active nano zinc oxide of 4-6 g, a distillation solution of smoldered monazite of 2-4 g, an amino acid of 1-3 g, a nano aerogel of 1-3 g, purification water of 80-120 g.

14. The cigarette filter as claimed in claim 10, wherein the filter fluid of the fifth layer is prepared from the following raw materials: citric acid of 65 g, urea of 10 g, vitamin C of 10 g, chitosan of 3 g, a distillation solution of smoldered active nano zinc oxide of 5 g, a distillation solution of smoldered monazite of 3 g, an amino acid of 2 g, a nano aerogel of 2 g, purification water of 100 parts by weight.

15. The cigarette filter as claimed in claim 13, wherein a preparing method of the distillation solution of smoldered active nano zinc oxide comprises: placing nano zinc oxide in a high-temperature furnace at 1800-2200° C., firing the nano zinc oxide for 75-105 min and then cooling down to obtain a fired power; and placing the fired powder in a cloth bag of 800-1200 meshes and then evaporating in a steam oven to obtain the distillation solution.

16. The cigarette filter as claimed in claim 13, wherein a preparing method of the distillation solution of smoldered monazite comprises: crushing a monazite to obtain a crushed powder, placing the crushed powder in a high-temperature furnace at 1800-2200° C., firing the crushed powder for 75-105 min and then cooling down to obtain a fired powder; placing the fired powder in a cloth bag of 800-1200 meshes and then evaporating in a steam oven to obtain the distillation solution and a distilled monazite; and crushing the distilled monazite to obtain the smoldered and distilled monazite crystal powder.

17. The cigarette filter as claimed in claim 11, wherein the filter particles of the fourth layer are prepared by mixing the raw materials of the fourth layer to obtain a mixture, placing the mixture in a granulator for granulation to obtain particles with a size of 0.1-3 mm, and placing 30-100 particles as the filter particles in the fourth layer.

18. The cigarette filter as claimed in claim 13, wherein the filter fluid of the fifth layer is prepared by mixing the raw materials of the fifth layer evenly to obtain a mixture and dripping 0.1-3 ml of the mixture as the filter fluid into the filter cotton of the fifth layer at a bottom of the cigarette filter through using an automatic metering glue dripping machine.

19. A cigarette filter comprising six layers; wherein the six layers comprise a first layer including filter cotton with an activated carbon, a second layer including five-hole glue, a third layer including filter cotton, a fourth layer including filter particles, a fifth layer including filter cotton with filter fluid, and a sixth layer including a silica gel cover; and the first though sixth layers are sequentially arranged from outside to inside in that order;

wherein raw materials of the filter particles comprise: nano-grade diatomaceous earth of 60-70 parts by weight, urea of 5-15 parts by weight, a lemon powder of 5-15 parts by weight, the activated carbon of 3-7 parts by weight with an iodine value of 1100, a nano aerogel of 2-4 parts by weight, nanometer titanium dioxide of 1-3 parts by weight, vitamin C of 1-5 parts by weight, chitosan of 0.5-1.5 parts by weight, a rock candy powder of 1-5 parts by weight, active nano zinc oxide of 1-5 parts by weight, a smoldered and distilled monazite crystal powder of 1-3 parts by weight and maize starch of 1-5 parts by weight; and wherein raw materials of the filter fluid comprise: citric acid of 60-70 parts by weight, urea of 5-15 parts by weight, vitamin C of 5-15 parts by weight, chitosan of 2-4 parts by weight, a distillation solution of smoldered active nano zinc oxide of 4-6 parts by weight, a distillation solution of smoldered monazite of 2-4 parts by weight, an amino acid of 1-3 parts by weight, a nano aerogel of 1-3 parts by weight, purification water of 80-120 parts by weight.

20. The cigarette filter as claimed in claim 19, wherein a preparing method of the distillation solution of smoldered active nano zinc oxide comprises: placing nano zinc oxide in a high-temperature furnace at 1800-2200° C., firing the nano zinc oxide for 75-105 min and then cooling down to obtain a fired power; and placing the fired powder in a cloth bag of 800-1200 meshes and then evaporating in a steam oven to obtain the distillation solution; and wherein a preparing method of the distillation solution of smoldered monazite comprises: crushing a monazite to obtain a crushed powder, placing the crushed powder in a high-temperature furnace at 1800-2200° C., firing the crushed powder for 75-105 min and then cooling down to obtain a fired powder; placing the fired powder in a cloth bag of 800-1200 meshes and then evaporating in a steam oven to obtain the distillation solution and a distilled monazite; and crushing the distilled monazite to obtain the smoldered and distilled monazite crystal powder.

* * * * *